US006516142B2

(12) United States Patent
Grant et al.

(10) Patent No.: US 6,516,142 B2
(45) Date of Patent: Feb. 4, 2003

(54) INTERNAL HEATING ELEMENT FOR PIPES AND TUBES

(75) Inventors: Mike A. Grant, Minnesota City, MN (US); Clifford D. Tweedy, St. Charles, MO (US); John W. Schlesselman, Fountain City, WI (US)

(73) Assignee: Watlow Polymer Technologies, Winona, MN (US)

( * ) Notice: Subject to any disclaimer, the term of this patent is extended or adjusted under 35 U.S.C. 154(b) by 0 days.

(21) Appl. No.: 09/781,456

(22) Filed: Feb. 12, 2001

(65) Prior Publication Data

US 2002/0090210 A1 Jul. 11, 2002

Related U.S. Application Data

(63) Continuation-in-part of application No. 09/756,162, filed on Jan. 8, 2001.

(51) Int. Cl.[7] ..... H05B 1/02
(52) U.S. Cl. ..... 392/451; 392/465
(58) Field of Search ..... 392/465, 466, 392/451, 459, 485, 487

(56) References Cited

U.S. PATENT DOCUMENTS

| | | | | |
|---|---|---|---|---|
| 1,043,922 A | 11/1912 | Gold | ..... | 219/523 |
| 1,046,465 A | 12/1912 | Hoyt | | |
| 1,058,270 A | 4/1913 | Stephens | ..... | 219/217 |

(List continued on next page.)

FOREIGN PATENT DOCUMENTS

| | | |
|---|---|---|
| DE | 35 12 659 A | 9/1986 |
| DE | 3512659 | 10/1986 |
| DE | 38 36 387 C1 | 5/1990 |
| GB | 14562 | 9/1913 |
| GB | 1070849 | 6/1967 |
| GB | 1325084 | 8/1973 |
| GB | 1498792 | 1/1978 |
| GB | 2244898 | 12/1999 |
| JP | 53-134245 | 11/1978 |
| JP | 3-129694 | 6/1991 |
| JP | 07 211438 A | 11/1995 |

OTHER PUBLICATIONS

"Polymers", *Guide to Selecting Engineered Materials*, a special issue of *Advanced Materials & Processes*, Metals Park, OH, ASM International, 1989, pp. 92–93.

"Makroblend Polycarbonate Blend, Tedur Polyphenylene Sulfide", *Machine Design: Basics of Design Engineering*, Cleveland, OH, Penton Publishing, Inc., Jun. 1991, pp. 820–821, 863, 866–867.

European Search Report, Jul. 13, 1998.

"At HEI, Engineering is our Middle Name", Heaters Engineering, Inc., Mar. 2, 1995.

(List continued on next page.)

*Primary Examiner*—Teresa Walberg
*Assistant Examiner*—Thor Campbell
(74) *Attorney, Agent, or Firm*—Duane Morris LLP

(57) ABSTRACT

The heater includes a resistance heating element comprising a resistance heating wire having a pair of terminal ends connected to a pair of electrical connectors and encapsulated with a thin electrically insulating polymeric layer. The resistance heating wire is capable of maintaining a fluid initially heated by a primary heat source substantially at the desired use temperature. A first connecting body is configured to couple to the section of piping containing the fluid. The connecting body includes a fluid inlet port, a fluid outlet port, a fluid passageway defined between the fluid inlet and outlet ports, and an electrical connection port. The resistance heating element is disposed at least partially within the fluid passageway and at least a first one of the terminal ends is coupled to a respective one of the pair of electrical connectors through the electrical connection port.

17 Claims, 5 Drawing Sheets

U.S. PATENT DOCUMENTS

| | | | | | |
|---|---|---|---|---|---|
| 1,281,157 | A | | 10/1918 | Hadaway, Jr. | |
| 1,477,602 | A | | 12/1923 | Simon | |
| 1,674,488 | A | | 6/1928 | Tang | |
| 1,987,119 | A | | 1/1935 | Long | 219/39 |
| 1,992,593 | A | | 2/1935 | Whitney | 219/46 |
| 2,146,402 | A | | 2/1939 | Morgan | 219/523 |
| 2,202,095 | A | | 5/1940 | Delhaye et al. | 219/217 |
| 2,274,445 | A | | 2/1942 | Greer | 219/38 |
| 2,426,976 | A | | 9/1947 | Taulman | 219/19 |
| 2,456,343 | A | | 12/1948 | Tuttle | 201/67 |
| 2,464,052 | A | | 3/1949 | Numrich | 219/38 |
| 2,593,087 | A | | 4/1952 | Baggett | 219/217 |
| 2,593,459 | A | | 4/1952 | Johnson | 219/39 |
| 2,710,909 | A | | 6/1955 | Logan et al. | 219/46 |
| 2,719,907 | A | | 10/1955 | Combs | 219/46 |
| 2,804,533 | A | | 8/1957 | Nathanson | 219/522 |
| 2,889,439 | A | | 6/1959 | Musgrave | 219/19 |
| 2,938,992 | A | | 5/1960 | Crump | 219/46 |
| 3,061,501 | A | | 10/1962 | Dittman et al. | 156/250 |
| 3,173,419 | A | | 3/1965 | Dubilier et al. | 128/399 |
| 3,191,005 | A | | 6/1965 | Cox | 219/528 |
| 3,201,738 | A | | 8/1965 | Mitoff | 338/238 |
| 3,211,203 | A | | 10/1965 | Creed et al. | 146/81 |
| 3,238,489 | A | | 3/1966 | Hay | 388/250 |
| 3,296,415 | A | | 1/1967 | Eisler | 219/385 |
| 3,352,999 | A | | 11/1967 | Macoicz et al. | 219/321 |
| 3,374,338 | A | | 3/1968 | Morey | 219/529 |
| 3,385,959 | A | | 5/1968 | Ames et al. | |
| 3,496,517 | A | | 2/1970 | Walter | 339/18 |
| 3,535,494 | A | | 10/1970 | Armbruster | 219/528 |
| 3,564,589 | A | | 2/1971 | Arak | 219/331 |
| 3,573,430 | A | | 4/1971 | Eisler | 219/385 |
| 3,597,591 | A | | 8/1971 | Van Derlip | 219/528 |
| 3,614,386 | A | | 10/1971 | Hepplewhite | 219/312 |
| 3,621,566 | A | * | 11/1971 | Welsh | 29/610.1 |
| 3,623,471 | A | | 11/1971 | Bogue et al. | 126/263.01 |
| 3,648,659 | A | | 3/1972 | Jones | 119/1 |
| 3,657,516 | A | | 4/1972 | Fujihara | 219/345 |
| 3,657,517 | A | | 4/1972 | Hoyt | 219/535 |
| D224,406 | S | | 7/1972 | Heck | D26/1 |
| 3,678,248 | A | | 7/1972 | Ticault et al. | 219/525 |
| 3,683,361 | A | | 8/1972 | Salzwedel | 338/322 |
| 3,686,472 | A | | 8/1972 | Harris | 219/213 |
| 3,707,618 | A | | 12/1972 | Zeitlin et al. | 219/336 |
| 3,725,645 | A | | 4/1973 | Shevlin | 219/521 |
| 3,774,299 | A | | 11/1973 | Sato et al. | 29/611 |
| 3,781,526 | A | | 12/1973 | Damron | 219/538 |
| 3,808,403 | A | | 4/1974 | Kanaya et al. | 219/528 |
| 3,831,129 | A | | 8/1974 | Frey | 339/19 |
| 3,859,504 | A | | 1/1975 | Motokawa et al. | 219/528 |
| 3,860,787 | A | | 1/1975 | Strobach | 219/336 |
| 3,878,362 | A | | 4/1975 | Stinger | 219/528 |
| 3,888,711 | A | | 6/1975 | Breitner | 156/93 |
| 3,889,047 | A | * | 6/1975 | Carver | 156/49 |
| 3,900,654 | A | | 8/1975 | Stinger | 428/214 |
| 3,908,749 | A | | 9/1975 | Williams | 165/2 |
| 3,927,300 | A | | 12/1975 | Wada et al. | 219/381 |
| 3,933,550 | A | | 1/1976 | Erwin | 156/85 |
| 3,943,328 | A | | 3/1976 | Cunningham | 219/335 |
| 3,952,182 | A | | 4/1976 | Flanders | 219/309 |
| 3,968,348 | A | | 7/1976 | Stanfield | 219/535 |
| 3,974,358 | A | | 8/1976 | Goltsos | 219/387 |
| 3,976,855 | A | | 8/1976 | Altmann et al. | 219/532 |
| 3,985,928 | A | | 10/1976 | Watanabe et al. | 428/273 |
| 3,987,275 | A | | 10/1976 | Hurko | 219/461 |
| 4,021,642 | A | | 5/1977 | Fields, Jr. | 219/391 |
| 4,038,519 | A | | 7/1977 | Foucras | 219/301 |
| 4,046,989 | A | | 9/1977 | Parise et al. | 219/437 |
| 4,058,702 | A | | 11/1977 | Jerles | 219/321 |
| 4,060,710 | A | | 11/1977 | Reuter et al. | 219/548 |
| 4,068,115 | A | | 1/1978 | Mack et al. | 219/386 |
| 4,083,355 | A | | 4/1978 | Schwank | 126/39 J |
| 4,094,297 | A | | 6/1978 | Ballentine | 126/39 J |
| 4,102,256 | A | | 7/1978 | John et al. | 99/372 |
| 4,112,410 | A | | 9/1978 | Wrob et al. | 338/243 |
| 4,117,311 | A | | 9/1978 | Sturm | 219/544 |
| 4,119,834 | A | | 10/1978 | Losch | 392/418 |
| 4,152,578 | A | | 5/1979 | Jacobs | 219/336 |
| 4,158,078 | A | | 6/1979 | Egger et al. | 428/102 |
| 4,176,274 | A | | 11/1979 | Lippera | 219/522 |
| 4,186,294 | A | | 1/1980 | Bender | 219/527 |
| 4,201,184 | A | | 5/1980 | Scheidler et al. | 126/39 J |
| 4,217,483 | A | | 8/1980 | Vogel et al. | 219/541 |
| 4,224,505 | A | | 9/1980 | Sturm | 219/544 |
| 4,233,495 | A | | 11/1980 | Scoville et al. | 219/386 |
| 4,245,149 | A | | 1/1981 | Fairlie | 219/528 |
| 4,250,397 | A | | 2/1981 | Gray et al. | 392/435 |
| 4,272,673 | A | | 6/1981 | Semanaz et al. | 219/544 |
| 4,294,643 | A | | 10/1981 | Tadewald | 156/293 |
| 4,296,311 | A | | 10/1981 | Hagglund et al. | 219/464 |
| 4,304,987 | A | | 12/1981 | van Konynenburg | 219/553 |
| 4,313,053 | A | | 1/1982 | Sturm | 219/544 |
| 4,313,777 | A | | 2/1982 | Buckley et al. | 156/272 |
| 4,321,296 | A | | 3/1982 | Rougier | 428/212 |
| 4,326,121 | A | | 4/1982 | Welsby et al. | 219/523 |
| 4,334,146 | A | | 6/1982 | Sturm | 219/492 |
| 4,337,182 | A | | 6/1982 | Needham | 524/609 |
| 4,346,277 | A | | 8/1982 | Wojtecki et al. | 219/528 |
| 4,346,287 | A | | 8/1982 | Desloge | 219/541 |
| 4,349,219 | A | | 9/1982 | Sturm | 285/21 |
| 4,354,096 | A | | 10/1982 | Dumas | 219/523 |
| 4,358,552 | A | | 11/1982 | Shinohara et al. | 523/443 |
| 4,364,308 | A | | 12/1982 | John et al. | 99/351 |
| 4,375,591 | A | | 3/1983 | Sturm | 219/544 |
| 4,387,293 | A | | 6/1983 | Grice et al. | 219/529 |
| 4,388,607 | A | | 6/1983 | Toy et al. | 338/22 SD |
| 4,390,551 | A | | 6/1983 | Swartley et al. | 426/107 |
| 4,419,567 | A | | 12/1983 | Murphy et al. | 219/336 |
| 4,429,215 | A | | 1/1984 | Sakai et al. | 219/528 |
| 4,436,988 | A | | 3/1984 | Blumenkranz | 219/544 |
| 4,482,239 | A | | 11/1984 | Hosono et al. | 355/3 |
| 4,493,985 | A | | 1/1985 | Keller | 219/535 |
| 4,501,951 | A | | 2/1985 | Benin et al. | 219/243 |
| 4,530,521 | A | | 7/1985 | Nyffeler et al. | 285/21 |
| 4,534,886 | A | | 8/1985 | Kraus et al. | 252/502 |
| 4,540,479 | A | | 9/1985 | Sakurai et al. | 204/427 |
| 4,606,787 | A | | 8/1986 | Pelligrino | 156/632 |
| 4,633,063 | A | | 12/1986 | Willis | 219/243 |
| 4,640,226 | A | | 2/1987 | Liff | 119/1 |
| 4,641,012 | A | | 2/1987 | Roberts | 219/331 |
| 4,658,121 | A | | 4/1987 | Horsma et al. | 219/553 |
| 4,680,446 | A | * | 7/1987 | Post | 122/13.3 |
| 4,687,905 | A | | 8/1987 | Cunningham et al. | 219/336 |
| 4,703,150 | A | | 10/1987 | Kunnecke et al. | 219/535 |
| 4,707,590 | A | | 11/1987 | Lefebvre | 219/523 |
| 4,725,717 | A | | 2/1988 | Harrison | 219/528 |
| 4,730,148 | A | | 3/1988 | Nakata | 315/397 |
| 4,751,528 | A | | 6/1988 | Spehrley, Jr. et al. | 346/140 |
| 4,756,781 | A | | 7/1988 | Etheridge | 156/85 |
| 4,762,980 | A | * | 8/1988 | Insley | 338/305 |
| 4,784,054 | A | | 11/1988 | Karos et al. | 99/483 |
| 4,797,537 | A | | 1/1989 | Berthelius et al. | 219/528 |
| 4,845,343 | A | | 7/1989 | Aune et al. | 219/545 |
| 4,860,434 | A | | 8/1989 | Louison et al. | 29/611 |
| 4,865,014 | A | | 9/1989 | Nelson | 129/361 |
| 4,865,674 | A | | 9/1989 | Durkin | 156/158 |
| 4,866,252 | A | | 9/1989 | Van Loo et al. | 219/535 |
| 4,904,845 | A | | 2/1990 | Wonka | 219/280 |
| 4,911,978 | A | | 3/1990 | Tsubone et al. | 428/317.9 |
| 4,913,666 | A | | 4/1990 | Murphy | 439/709 |
| 4,927,999 | A | | 5/1990 | Hanselka | 219/535 |

| | | | | |
|---|---|---|---|---|
| 4,948,948 | A | 8/1990 | Lesage | 219/329 |
| 4,956,138 | A | 9/1990 | Barfield | 264/129 |
| 4,970,528 | A | 11/1990 | Beaufort et al. | 346/25 |
| 4,972,197 | A | 11/1990 | McCauley et al. | 343/704 |
| 4,982,064 | A | 1/1991 | Hartman et al. | 219/727 |
| 4,983,814 | A | 1/1991 | Ohgushi et al. | 219/545 |
| 4,986,870 | A | 1/1991 | Frohlich | 156/382 |
| 4,993,401 | A | 2/1991 | Diekmann et al. | 126/39 |
| 5,003,693 | A | 4/1991 | Atkinson et al. | 29/849 |
| 5,013,890 | A | 5/1991 | Gamble | 392/497 |
| 5,021,805 | A | 6/1991 | Imaizumi et al. | 346/76 R |
| 5,023,433 | A | 6/1991 | Gordon | 219/548 |
| 5,038,458 | A | 8/1991 | Wagoner et al. | 29/593 |
| 5,041,846 | A | 8/1991 | Vincent et al. | 346/25 |
| 5,051,275 | A | 9/1991 | Wong | 427/58 |
| 5,066,852 | A | 11/1991 | Willbanks | 219/544 |
| 5,068,518 | A | 11/1991 | Yasuda | 219/549 |
| 5,073,320 | A | 12/1991 | Sterzel | 264/101 |
| 5,111,025 | A | 5/1992 | Barma et al. | 29/217 |
| 5,113,480 | A | 5/1992 | Murphy et al. | 392/501 |
| 5,129,033 | A | 7/1992 | Ferrara et al. | 392/447 |
| 5,136,143 | A | 8/1992 | Kutner et al. | 219/544 |
| 5,155,800 | A | 10/1992 | Rezabek et al. | 382/503 |
| 5,162,634 | A | 11/1992 | Kusaka | 219/216 |
| 5,184,969 | A | 2/1993 | Sharpless et al. | 445/24 |
| 5,208,080 | A | 5/1993 | Gajewski et al. | 428/1 |
| 5,221,419 | A | 6/1993 | Beckett | 156/630 |
| 5,221,810 | A | 6/1993 | Spahn | 102/475 |
| 5,237,155 | A | 8/1993 | Hill | 219/544 |
| 5,252,157 | A | 10/1993 | Inhofe, Jr. | 156/158 |
| 5,255,595 | A | 10/1993 | Higgins | 99/378 |
| 5,255,942 | A | 10/1993 | Kenworthy | 285/21 |
| 5,287,123 | A | 2/1994 | Medin et al. | 346/140 R |
| 5,293,446 | A | 3/1994 | Owens et al. | 392/449 |
| 5,300,760 | A | 4/1994 | Batliwalla et al. | 219/549 |
| 5,302,807 | A | 4/1994 | Zhao | 219/211 |
| 5,304,778 | A | 4/1994 | Dasgupta et al. | 219/270 |
| 5,313,034 | A | 5/1994 | Grimm | 156/274.2 |
| 5,389,184 | A | 2/1995 | Jacaruso et al. | 156/378 |
| 5,397,873 | A | 3/1995 | Stoops et al. | 219/450 |
| 5,406,316 | A | 4/1995 | Schwiebert et al. | 347/18 |
| 5,406,321 | A | 4/1995 | Schwiebert et al. | 347/102 |
| 5,408,070 | A | 4/1995 | Hyllberg | 392/503 |
| 5,453,599 | A | 9/1995 | Hall, Jr. | 219/544 |
| 5,461,408 | A | 10/1995 | Giles et al. | 347/102 |
| 5,476,562 | A | 12/1995 | Inhofe, Jr. | 156/156 |
| 5,477,033 | A | 12/1995 | Bergholtz | 219/549 |
| 5,497,883 | A | 3/1996 | Monetti | 206/545 |
| 5,500,667 | A | 3/1996 | Schwiebert et al. | 347/102 |
| 5,520,102 | A | 5/1996 | Monetti | 99/483 |
| 5,521,357 | A | 5/1996 | Lock et al. | 219/543 |
| 3,268,846 | A | 8/1996 | Morey | 338/212 |
| 5,571,435 | A | 11/1996 | Needham | 219/544 |
| 5,572,290 | A | 11/1996 | Ueno et al. | 399/329 |
| 5,581,289 | A | 12/1996 | Firl et al. | 347/104 |
| 5,582,754 | A | 12/1996 | Smith et al. | 219/438 |
| 5,586,214 | A | 12/1996 | Eckman | 392/503 |
| 5,618,065 | A | 4/1997 | Akiyama | 285/21.2 |
| 5,619,240 | A | 4/1997 | Pong et al. | 347/103 |
| 5,625,398 | A | 4/1997 | Milkovits et al. | 347/104 |
| 5,633,668 | A | 5/1997 | Schwiebert et al. | 347/102 |
| 5,691,756 | A | 11/1997 | Rise et al. | 347/102 |
| 5,697,143 | A | 12/1997 | Barfield | 29/611 |
| 5,703,998 | A | 12/1997 | Eckman | 392/340 |
| 5,708,251 | A | 1/1998 | Naveh | 219/121.66 |
| 5,714,738 | A | 2/1998 | Hauschulz et al. | 219/535 |
| 5,779,870 | A | 7/1998 | Seip | 205/77 |
| 5,780,817 | A | 7/1998 | Eckman et al. | 219/458 |
| 5,780,820 | A | 7/1998 | Komyoji et al. | 219/543 |
| 5,781,412 | A | 7/1998 | De Sorgo | 361/704 |
| 5,806,177 | A | 9/1998 | Hosomi et al. | 29/846 |
| 5,811,796 | A | 9/1998 | Schiffmann et al. | 219/762 |
| 5,822,675 | A | 10/1998 | Paquet et al. | 428/561 |
| 5,824,996 | A | 10/1998 | Kochman et al. | 219/529 |
| 5,829,171 | A | 11/1998 | Weber et al. | 36/93 |
| 5,835,679 | A | 11/1998 | Eckman et al. | 392/503 |
| 5,856,650 | A | 1/1999 | Rise et al. | 219/216 |
| 5,902,518 | A | 5/1999 | Khazai et al. | 252/511 |
| 5,930,459 | A | 7/1999 | Eckman | 392/503 |
| 5,940,895 | A | 8/1999 | Wilson et al. | 4/237 |
| 5,947,012 | A | 9/1999 | Ewald et al. | 99/374 |
| 5,954,977 | A | 9/1999 | Miller et al. | 219/201 |
| 5,961,869 | A | 10/1999 | Irgens | 219/549 |
| 6,056,157 | A | 5/2000 | Gehl et al. | 222/94 |
| 6,089,406 | A | 7/2000 | Feldner | 222/103 |
| 6,137,098 | A | 10/2000 | Moseley et al. | 219/727 |
| 6,147,332 | A | 11/2000 | Holmberg et al. | 219/526 |
| 6,147,335 | A | 11/2000 | Von Arx et al. | 219/544 |
| 6,150,635 | A | 11/2000 | Hannon et al. | 219/386 |
| 6,162,385 | A | 12/2000 | Gross-Puppendahl et al. | 264/250 |
| 6,205,292 | B1 * | 3/2001 | Pokorny et al. | 392/465 |

OTHER PUBLICATIONS

"Flexibility and cost Savings with Rope Elements", Heating Engineers, Inc. Aug. 1998.

Desloge Engineering Col, Letter to Lou Steinhauser dated Feb. 19, 1997.

Immersion Heaters Oil and Water, p. 11 (19___)v.

Special Purpose Flange Heaters, p. 58 (19___).

Lakewood Trade Literature entitled "Oil–Filled Radiator Heater" (19___).

Encon Drawing Part Nos. 02–06–480 & 02–06–481 (19___).

Encon Drawing No. 500765 (Jun. 10, 1987).

Vulcan Electric Company Trade Literature entitled "Bushing Immersion Heaters", 1983.

Trade Literature "Euro–Burner Solid Disc Converson Burners" Energy Convertors, Inc., Dallas, PA 1991.

"Polymers," *Guide to Selecting Engineering Materials*, a special issue of Advanced Materials& Presses, Metals Park, OH, ASM International, 1990, pp. 32–33.

Machine Design, "Basics of Design Engineering" Jun. 1991, pp. 429–432, 551, 882–884.

Machine Design, "Basics of Design Engineering", Jun. 1994, pp 624–631.

Machine Design, May 18, 2000, 3 pages.

Carvill, Wm. T., "Prepreg Resins", Enginerred Materials Handbook, vol. 1, Composites pp. 139–142.

Thermoplastic Polyimide (TPI) Features, RTP Company's 4200 series compounds (4 pages).

World Headquarters, RTP Co, RTP 1300 Series Polyphenylene Sulfide Compounds, 1 page.

World Headquarters, RTP Co, RTP 2100 Series Polyethermide Compounds, 1 page.

World Headquarters, RTP Co, RTP 3400 Series Liquid Crystal Polymer Compounds, 1 page.

World Headquarters, RTP Co, RTP 4200 Series Thermoplastic Polyimide Compounds, 1 page.

A.M. Wittenberg, "Pin Shorting Contact," Western Electric Technical Digest No. 60, Oct. 1980, p. 25.

International Search Report, Aug. 8, 2000.

Kronenberg, K.J., "Magnetic Water Treatment De–Mystified", Green Country Environmental Associates, LLC, pp 1–8.

* cited by examiner

INTERNAL HEATING ELEMENT FOR PIPES AND TUBES

CROSS-REFERENCE TO RELATED APPLICATIONS

This application is a continuation in part of U.S. application Ser. No. 09/756,162 to Theodore Von Arx, Clifford D. Tweedy, Keith Laken and David Adank, filed Jan. 8, 2001, entitled "Flexible Spirally Shaped Heating Element," the entirety of which is hereby incorporated by reference herein.

FIELD OF THE INVENTION

This invention relates to electric resistance heating elements, and more particularly, to plastic insulated resistance heating elements containing encapsulated resistance material.

BACKGROUND OF THE INVENTION

Single heating element fluid heaters tend to develop a temperature cycle where the temperature of the heated fluid repeatedly varies between a maximum and a minimum temperature over a period of time. The fluid is initially heated to the maximum temperature, at which point the heating element of the fluid heater is deactivated. The fluid then loses heat do to radiant and convective cooling. The fluid heater is designed to reactivate the heating element when the temperature of the fluid falls below a selected minimum temperature, at which point the fluid is again heated to the selected maximum temperature. The temperature cycle then repeats itself.

Because the fluid heater typically includes a single large wattage heat source that is capable of quickly heating the fluid from an ambient temperature or below to the desired elevated temperature, the constant cycle of switching the large wattage heat element "on" and "off" is quite electrically inefficient as well as damaging to the high wattage heating element. This problem was recognized in U.S. Pat. No. 5,703,998 to Charles M. Eckman, entitled "Hot water tank assembly," issued Dec. 30, 1997, the entirety of which is hereby incorporated by reference herein.

Eckman '988 discloses a hot water heater having a first and second resistance wires. Both wires are activated to initially heat the water to at least the temperature of a hot beverage. Once this temperature is reached, the first resistance wire is deactivated, and the second resistance wire remains energized to maintain the water at the hot beverage temperature. The heating element of Eckman '988 includes a resistance heating coil surrounded by a corrosive resistant sheath. The sheath and the coil are insulated from each other by an insulating medium, such as a powdered ceramic material.

A single length of resistance wire coated with a polymeric layer has also been proposed as a fluid heater, such as in U.S. Pat. No. 4,326,121 to Welsby et al., entitled "Electric immersion heater for heating corrosive liquids," issued Apr. 20, 1982, the entirety of which is hereby incorporated herein by reference. Welsby et al. '121 discloses an electric immersion heater having a planar construction which contains an electrical resistance heating wire shrouded within an integral layer of polymeric material, such as PFA or PTFE, which is wound around end portions of a rectangular frame. The frame and wound resistance wire are then secured in spaced relationship with one or more wrapped frame members, and then further protected by polymeric cover plates which allow for the free flow of fluid through the heater.

While Welsby et al. '121 illustrates one possible application for a polymeric coated resistance heating wire, and Eckman '988 provides an approach to counteract the inefficiencies of temperature cycling inherent in fluid heaters containing single large wattage heating elements, neither reference accounts for heat losses that may occur downstream from the primary fluid heat source, e.g., in a piping section in fluid communication with an output of the primary heat source for the fluid. Further, neither reference provides a retrofitable solution to this problem.

As an example, a typical hot beverage vending machine, such as a coffee, tea or hot chocolate vending machine, contains a primary fluid heat source and a length of piping that connects the primary heat source to a dispensing outlet for the beverage. If the machine is in constant use, the temperatures of the beverages dispensed from the machine all fall within a fairly consistent and acceptable range, i.e., the beverage does not remain within the piping section leading to the dispensing outlet long enough to cool to a temperature below an acceptable temperature. If the machine is in disuse for any lengthy period of time however, such as for a few hours or overnight, any beverage contained in the piping section loses an unacceptable amount of its heat and is generally non-potable. These cold beverages are typically discarded. Over the life of the machine, this wasteful practice can amount to significant lost revenues.

Therefore, there remains a need for a heater that is capable of heating a fluid downstream from a primary heat source, thereby eliminating the wasteful discarding of unheated products all while doing so in an energy efficient manner. Still further, is desirable to be able to retrofit this functionality into existing heating applications in a capital and labor efficient manner.

SUMMARY OF THE INVENTION

The present invention provides a heater for maintaining a fluid substantially at a desired use temperature while said fluid is disposed in a section of piping disposed in fluid communication with an output of a primary heat source for the fluid that initially heats the fluid to at least the desired use temperature. The heater comprises a resistance heating element comprising a resistance heating wire having a pair of terminal ends connected to a pair of electrical connectors. The resistance heating wire is encapsulated within a thin electrically insulating polymeric layer. The resistance heating wire is capable of maintaining the fluid substantially at the desired use temperature. A heater includes a first connecting body configured to be coupled to the section of piping and including a first fluid inlet port, a first fluid outlet port, a first electrical connection port and a first fluid passageway defined between the first fluid inlet port and the first fluid outlet port. The resistance heating element is disposed at least partially within the first fluid passageway, and at least a first one of the terminal ends is coupled to a respective one of the electrical connectors through the first electrical connection port.

The heater of the present invention allows for efficient heating of a fluid downstream from a primary fluid heat source in order to maintain the desired use temperature of the fluid. The heater eliminates the need to reheat the fluid after it has lost a significant portion of its heat and/or the need to discard the cooled fluid. The heater may be easily retrofitted into existing fluid heating applications, particularly where downstream heating is desirable but had not previously been considered. Further, the heater is capable of utilizing existing pipe fittings and pipe fitting techniques.

The above and other features of the present invention will be better understood from the following detailed description of the preferred embodiments of the invention that is provided in connection with the accompanying drawings.

A BRIEF DESCRIPTION OF THE DRAWINGS

The accompanying drawings illustrate preferred embodiments of the invention, as well as other information pertinent to the disclosure, in which.

DETAILED DESCRIPTION OF THE INVENTION

Figure 1:
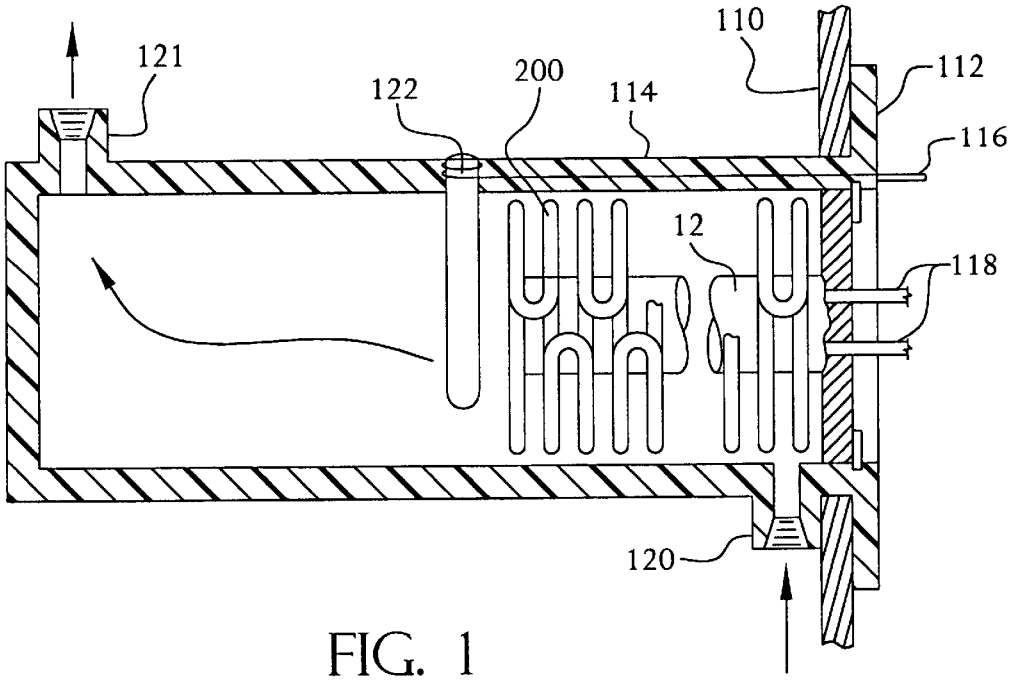
FIG. 1 is a side, cross-sectional view of a preferred heating element embodiment of this invention, including an optional element container.

The present invention provides polymeric heating elements useful in all sorts of heating environments, especially those for heating liquids in industrial and commercial applications, including pools and spas, food service (including food warmers, cheese and hot fudge dispensers and cooking surfaces and devices), water heaters, plating heaters, oil-containing space heaters, and medical devices. The disclosed heating elements can serve as replaceable heating elements for hot water service, including hot water storage capacities of 5–500 gallons, point of use hot water heaters, and retrofit applications. They can be used for instant-on type heaters, especially with the disclosed element container. As used herein, the following terms are defined:

"Additives" means any substance added to another substance, usually to improve properties, such as, plasticizers, initiators, light stabilizers, fiber or mineral reinforcements, fillers and flame retardants.

"Composite Material" means any combination of two or more materials (reinforcing elements, fillers, and composite matrix binder), differing in form or composition on a macro scale. The constituents retain their identities: that is, they do not dissolve or merge completely into one another although they act in concert. Normally, the components can be physically identified and exhibit an interface between one another.

"Spiral" means one or more looped or continuous forms of any geometric shape, including rectangular and circular, moving around a fixed point or axis; multiple spirals need not be centered on the same point or axis; a spiral can include, for example, a coil of wire located substantially in a single plane, a springlike structure having a longitudinal axis, or a series of coils connected by "u" shaped bends.

"Spirally" means shaped like a spiral.

"Coefficient of Thermal Conductivity" means the property of a material to conduct thermal energy (also known as "K-value"); it is typically measured in w/m-° C.

"Flux" means the heat flow (W or watts) per unit area ($in^2$ or $m^2$) of a heating element; it is also referred to as the Heat Flux or Watt Density of a heating element.

"Scale" means the deposits of Ca or $CaCO_3$, along with trace amounts of other minerals and oxides, formed, usually, in layers, on surfaces exposed to water storage (especially heated water).

"Effective Relative Heated Surface Area" ($in^2/in^3$) means the area of heating element exposed to the solid, liquid or gas to be heated, excluding internal or unexposed surfaces, ("Effective Surface Area", $in^2$ )over the volume of heating element immersed in the material or fluid ("Active Element Volume", $in^3$), excluding flanges or wiring outside of said material or fluid which may make up part of the element.

"Integral Composite Structure" means a composite structure in which several structural elements, which would conventionally be assembled together by mechanical fasteners after separate fabrication, are instead adhered together, melt bonded, or laid up and cured, to form a single, complex, continuous structure. All or some of the assembly may be co-cured, or joined by heat, pressure or adhesive.

"Reinforced Plastic" means molded, formed, filament-wound, tape-wrapped, or shaped plastic parts consisting of resins to which reinforcing fibers, mats, fabrics, mineral reinforcements, fillers, and other ingredients (referred to as "Reinforcements") have been added before the forming operation to provide some strength properties greatly superior to those of the base resin.

"Tubular Heating Element" means a resistance heating element having a resistance heating wire surrounded by a ceramic insulator and shielded within a plastic, steel and/or copper-based tubular sleeve, as described in, for example, U.S. Pat. No. 4,152,578, issued May 1, 1979, and hereby incorporated by reference.

Other terms will be defined in the context of the following specification.

ELEMENT CONSTRUCTION

With reference to the drawings, and in particular to FIGS. 1–4 thereof, there is shown a preferred flexible spirally shaped heating element 200 including a resistance heating material 18 having an electrically insulating coating 16 thereon. The coated resistance heating material 10 is desirably shaped into a configuration which allows substantial expansion during heating of the element. More preferably, this substantial expansion is created through a series of connected, spirally shaped forms such as those disclosed in the spirally shaped heating elements 100, 200 and 300. Due to their length and non-constricting nature, such spirally shaped forms have the ability to expand and contract at a rate which is greater than a shorter, confined flat sinus member, such as that described by Welsh '566, or a wire which is fixed on a stamped metal plate, as shown by Welsby et al. '121. The preferred flexible spirally shaped heating elements

100 and 200 of this invention preferably are self-supporting, but can be wound around a central axis 14 of a core 12 and terminate in a pair of power leads 118 or 11. The core 12 desirably is of an insulating material, such as wood, ceramic, glass or polymer, although it can be of metallic construction if made part of the resistance heating function, or if the resistance heating material is coated in a polymer, glass or ceramic such as described in the preferred embodiments of this invention.

The power leads 11 and 118 are desirably terminated in a conventional manner such as by compression fittings, terminal end pieces or soldering. Plastic-insulated cold pins can also be employed.

The preferred heating element construction of this invention can be disposed within an element container 114, preferably including a molded polymeric material such as, polyethylene, polystyrene, PPS or polycarbonate. The element container 114 preferably allows enough room for the spirally shaped heating element 100, 200 or 300 to expand without constriction. The element also can optionally include a temperature or current sensing device 122, such as a circuit breaker, thermostat, RTD, solid state temperature sensor, or thermocouple. The temperature or current sensing device 122 can be disposed within the insulating coating 16, in the wall of the element container 114, in the core 12, or disposed in close proximity to the heating element 100, 200 or 300.

When an element container 114 is employed, it is desirable that the container have one or more openings, such as liquid inlet and outlets, 120 and 121. This permits the cold water to enter in the liquid inlet 120, and hot water to exit the liquid outlet 121. Alternatively, such a device can act independently of a water storage tank, as in for example, a point of use hot water dispenser or oil preheater, whereby fluid pipes are connected to the liquid inlets and outlets 120 and 121.

Figure 3:
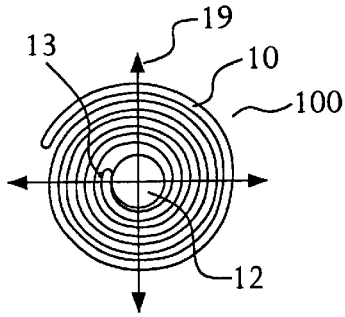
FIG. 3 is a side, elevational view of the spirally shaped heating element of FIG. 2.
Figure 5:
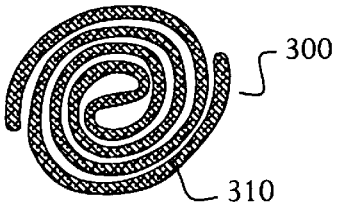
FIG. 5 is a side, elevational view of an alternative shaped heating element without a central core.
Figure 4:
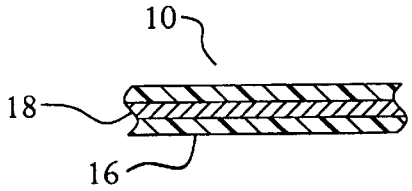
FIG. 4 is a partial, cross-sectional view, taken through line 4—4 of FIG. 2, showing a preferred construction of the heating element.

As shown in FIG. 3, the spirally shaped heating element of this invention can include a pair of axes of thermal expansion 17 and 19. Desirably, the spirally shaped heating element 100, 200 or 300 can expand at least about 1%, and more desirably, about 5–100% along such axes 17–19, as it unwinds and opens, to relieve mechanical stresses and improve descaling.

As shown in the preferred embodiments, FIGS. 2–5, the spirally shaped heating elements 100, 200 and 300 of this invention can include multiple connected spirals of coated resistance material 10 or 310 arranged along a common center line.

Figure 2:
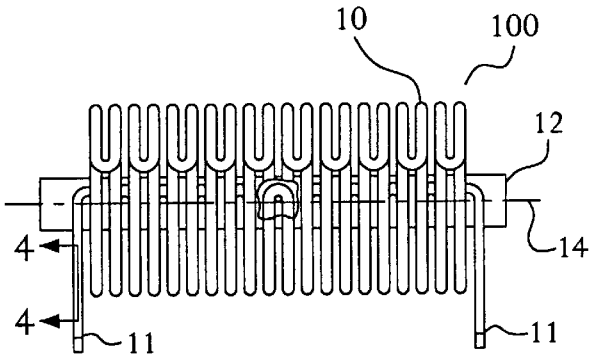
FIG. 2 is a top, plan view of an alternative spirally shaped heating element of this invention.

In the element 100 of FIGS. 2 and 3, the first pair of spirals is connected by a 180° turn of wire connecting the outer or inner ends of the first spiral. The third consecutive spiral is connected to the second spiral with a 180° turn of wire at the opposite end of the second spiral from the connection formed between the first and second spiral. This pattern is continued for the remaining spirals, alternating the 180° turn of wire connections between inter and outer ends of each spiral. These 180° turn connections are formed during the winding of the element which can be accomplished on a fixture having a plurality of pins for enabling the coated resistance heating material 10 to be wound and plastically deformed into a set spiral shape. The unconnected ends of the first and last spiral are connected to electrical leads (not shown). The individual spirals can be oval, rectangular or oddly shaped and, depending on the rigidity of the resistance wire or ribbon employed, may be supported without a core 12, as in element 300 of FIG. 5, and with or without an inner 180° turn. Optionally, the inner 180° turn can be fixed to the rod 12 by a pin 13 as shown in FIG. 3, or alternatively, by adhesive bond, weld, ultrasonic or solder joint.

The resistance heating material 18 may be a metal alloy or conductive coating or polymer, and may have a positive temperature coefficient of resistance for limiting heat or power in the case of overheating. The resistance heating material 18 may or may not be insulated within an insulating coating 16, depending upon the requirements for electrical insulation and the medium used or required application. The resistance heating material 18 of this invention may have a round, flat or other cross-sectional shape and may be solid or in powder form, and may be made of more than one alloy with different thermal expansion rates to increase the expansion or contraction of the spirally shaped heating elements 100 or 200 of this invention, with resulting improvements in the shedding of scale. Such bimetallic wire, having a longitudinal seam, is often used in residential thermostats, for example.

The spirally shaped heating elements 100, 200 or 300 of this invention may be formed with a wire or ribbon which is precoated with a polymer, thermoplastic or thermosetting resin before winding, or the wire may be wound with uncoated wire or ribbon, and then coated with a polymer by spray coating, dip coating, electrical coating, fluidized bed coating, electrostatic spraying, etc. The disclosed cores 12 may form a portion of the heating element or may be used merely to form its shape prior to disposing the core 12.

The spirally shaped heating elements of this invention, when used for residential water heating applications, are preferably designed to fit within a 1–1.5 in. diameter standard tank opening of typical hot water heaters. They are designed to have an "effective relative heated surface area" of about 5–60 $in^2/in^3$, desirably about 10–30 $in^2/in^3$.

The flexible, spiral shaped heating elements 100, 200 and 300 of this invention preferably include a resistance metal in ribbon or wire form and about 30–10 gauge sizes, preferably about 16–20 gauge, with coating thickness of about 0.001–0.020 inches, preferably about 0.005–0.012 inches. Desirable element examples have used 20 gauge Ni—Cr wire having a PFA coating of approximately 0.009 inches, resulting in an effective relative heated surface area of approximately 28 $in^2/in^3$, and sized to fit within a 1–1.5 inch diameter opening of a typical water heater.

The preferred coated or uncoated resistance wire or ribbon should be stiff enough to support itself, either alone or on a supporting carrier or core 12. The core 12 of this invention can be rod-like, rectangular, or contain a series of supporting rods or pins, such as a locating pin 13. A carrier, not illustrated, would be a metal or polymer bonded to, coextruded with, or coated over, the resistance heating material 18. The stiffness of the electrical resistance ribbon or wire can be achieved by gauge size, work hardening or by the selection of alloy combinations or conductive or non-conductive polymeric materials which are desirably self-supporting. This allows the spirally shaped heating element 100, 200 or 300 to provide differences in the radius of curvature during heating, and a much greater effective relative heated surface area than conventional tubular heaters (about 5 $in^2/in^3$) or cartridge heaters (about 4 $in^2/in^3$).

In further embodiments of this invention, the spirally shaped heating element 100, 200 or 300 can be constructed in a narrow diameter of approximately 1–6 in. which is thereafter expandable to about 2–30 inches, for example, after it is introduced through the side wall of a tank or container. This can be accomplished by retaining the spirally shaped heating element within a water soluble coating, band or adhesive, such as starch or cellulose, which is dissolved upon heating or by direct contact by a liquid, such as water. Alternatively; a low melting temperature coating, band, or adhesive, can be used, such as a 0.005–0.010 application of polyethylene or wax, for example.

Upon replacement of such spirally shaped heating elements, the flange 12, and any associated fasteners (not shown), can be removed with the coated or uncoated resistance heating material 10 being pulled through the 1–6 in. standard diameter opening. In the instance where a element container 114 is not employed, the spirally shaped heating element 100 can be removed through small openings by bending and deforming the individual spirals. Damage to the heating element at this point is not of any consequence, since the element will be discarded anyway.

GENERAL ELEMENT MATERIALS

The preferred electrical resistance heating material 18 contains a material which generates heat when subjected to electric current. It can be coated by an insulating coating 16, or left uncoated. Such materials are usually inefficient conductors of electricity since their generation of resistance heat is usually the result of high impedance. The preferred electrical resistance material can be fashioned into at least 2–1000 spirals. The resistance heating material can take the form of a wire, braid, mesh, ribbon, foil, film or printed circuit, such as a photolithographic film, electrodeposition, tape, or one of a number of powdered conducting or semi-conducting metals, polymers, graphite, or carbon, or one of these materials deposited onto a spiral carrier surface, which could be a polymer, metal or other fluid-resistant surface. Conductive inks can be deposited, for example, by an ink jet printer onto a flexible substrate of another material, such as plastic. Preferably, if a wire or ribbon is used, the resistance heating wire 18 or ribbon contains a Ni—Cr alloy, although certain copper, steel, and stainless-steel alloys, or even conductive and semi-conductive polymers can be used. Additionally, shape memory alloys, such as Nitinol® (Ni—Ti alloy) and Cu—Be alloys, can be used for carriers for the spirals.

The resistance heating wire 18 can be provided in separate parallel paths, for example, a pair of wires or ribbons, separated by an insulating layer, such as polymer, or in separate layers of different resistance materials or lengths of the same material, to provide multiple wattage ratings. Whatever material is selected, it should be electrically conductive, and heat resistant.

Since it is desirable for the electrical resistance material 18 to be in a spiral form that is capable of expanding and contracting when heated or energized, a minimum gauge of 30 g is desirable, preferably about 3–10 g and more preferably about 20–16 g, not including the insulating coating 16. In practice, it is expected that the electrical resistance material 18, in the preferred wire or ribbon form, be wound into at least one curved form or continuously bending line, such as a spiral, which has at least one free end or portion which can expand or contract at least 0.5–5 mm, and preferably at least about 5–10% of its original outer dimension. In the preferred embodiment, this free end portion is a 180° looped end, shown in FIGS. 1 and 2. Alternatively, said expansion and contraction should be sufficient to assist in descaling some of the mineral deposits which are known to build up onto electrical resistance heating elements in liquid heating applications, especially in hot water service. Such mineral deposits can include, for example, calcium, calcium-carbonate, iron oxide, and other deposits which are known to build up in layers over time, requiring more and more current to produce the same watt density, which eventually results in element failure.

The insulating coating 16, if employed, is preferably polymeric, but can alternatively contain any heat resistant, thermally conductive and preferably non-electrically conductive material, such as ceramics, clays, glasses, and semi-conductive materials, such as gallium arsenide or silicon. Additionally, cast, plated, sputter-coated, or wrought metals, such as aluminum, copper, brass, zinc and tin, or combinations thereof, could be used, if the resistance wire or material is insulated in a coating such as glass, ceramic, or high temperature polymer, or if electrical shorting is not an issue, such as in connection with the heating of dry materials or non-flammable gases, such as air.

The preferred insulating coating 16 of this invention is made from a high-temperature polymeric resin including a melting or degradation temperature of greater than 93° C. (200° F.). High temperature polymers known to resist deformation and melting at operating temperatures of about 75–85° C. are particularly useful for this purpose. Both thermoplastics and thermosetting polymers can be used. Preferred thermoplastic materials include, for example: fluorocarbons (such as PTFE, ETFE, PFA, FEP, CTFE, ECTFE, PVDF, PVF, and copolymers thereof), polypropylene, nylon, polycarbonate, polyetherimide, polyether sulfone, polyaryl-sulfones, polyimides, and polyetheretherkeytones, polyphenylene sulfides, polyether sulfones, and mixtures and co-polymers of these thermoplastics. Preferred thermosetting polymers include epoxies, phenolics, and silicones. Liquid-crystal polymers can also be employed for improving high-temperature use, such as for example, RTP 3400–350MG liquid crystal polymer from RTP Company, Winona, Min. Also useful for the purposes of this invention are bulk molding compounds ("BMCs"), prepregs, or sheet molding compounds ("SMCs") of epoxy reinforced with about 5–80 wt % glass fiber. A variety of commercial epoxies are available which are based on phenol, bisphenol, aromatic diacids, aromatic polyamines and others, for example, Lytex 930, available from Quantum Composites, Midland, Mich. Conductive plastics, such as RTP 1399X86590B conductive PPS thermoplastic, could also be used, with or without a further resistance heating material, such as those described above. Applicant has found a thin layer, about 0.005–0.012 in of PFA to be most desirable for this invention. Tests have shown that the thin polymer coatings and high Effective Relative Heated Surface Area of these elements arrests scale development by increasing the water solubility of Ca and $CaCo_3$ proximate to the element, providing greater element life.

It is further understood that, although thermoplastic resins are desirable for the purposes of this invention, because they are generally heat-flowable, some thermoplastics, notably polytetraflouroethylene (PTFE) and ultra high-molecular-weight polyethylene (UHMWPE) do not flow under heat alone. Also, many thermoplastics are capable of flowing without heat, under mechanical pressure only. On the other hand, thermosetting polymers are usually heat-settable, yet many thermosetting plastics such as silicone, epoxy and polyester, can be set without being heated. Another thermosetting material, phenolic, must first be made to flow under heat, like a thermoplastic, before it can be heat-set. For the most part, however, thermosetts are known to cross-link and thermoplastics do not.

As stated above, the insulating coating 16 of this invention preferably also includes reinforcing fibers, such as glass, carbon, aramid (Kevlar®), steel, boron, silicon carbide, polyethylene, polyamide, or graphite fibers. Glass reinforcement can further improve the maximum service temperature of the insulating coating 16 for no-load applications by about 50° F. The fibers can be disposed throughout the polymeric material in amounts of about 5–75 wt % prior to, or after coating or forming the final heating elements 100 or 200, and can be provided in single filament, multi-filament thread, yarn, roving, non-woven or woven fabric. Porous substrates, discussed further below, such as ceramic and glass wafers can also be used with good effect.

In addition to reinforcing fibers, the insulating coating 16 may contain thermally conducting, preferably non-electrically conducting, additives in amounts of about 5–80 wt %. The thermally-conducting additives desirably include ceramic powder such as, for example, $Al_2O_3$, MgO, $ZrO_2$, Boron nitride, silicon nitride, $Y_2O_3$, SiC, $SiO_2$, $TiO_2$, etc., or a thermoplastic or thermosetting polymer which is more thermally conductive than the polymer matrix of the insulating coating 16. For example, small amounts of liquid-crystal polymer or polyphenylene sulfide particles can be added to a less expensive base polymer such as epoxy or polyvinyl chloride, to improve thermal conductivity. Alternatively copolymers, alloys, blends, and interpenetrating polymer networks (IPNs) could be employed for providing improved thermal conductivity, better resistance to heat cycles and creep.

In view of the foregoing, it can be realized that this invention provides flexible, spirally shaped heating elements which provide a greatly improved effective relative heated surface area, a higher degree of flexing to remove scale, and much lower watt densities for minimizing fluid damage and avoiding scale build up. The heating elements of this invention can be used for hot water storage applications, food service and fuel and oil heating applications, consumer devices such as hair dryers, curling irons etc., and in many industrial applications.

PIPE/TUBE INTERNAL HEATING ELEMENT CONSTRUCTION

The heater illustrated in FIGS. 6–11 is particularly adapted to be used in connection with a primary fluid heat source. The primary fluid heat source initially heats a fluid to a temperature at least equal to a desired use temperature for the fluid, e.g, in a hot beverage application, to a temperature at least that acceptable for a hot beverage. The fluid travels through a piping system from the primary heat source to an output where it is dispensed. It is recognized that the heated fluid can lose heat during this migration, particularly when the fluid lies stagnant in a section of piping for any prolonged period of time. It is also recognized that it is more efficient in many applications to provide heat to maintain the fluid at its desired use temperature once achieved rather than (1) reheat the fluid to the desired use temperature after it has lost a significant portion of its heat or (2) discard the unheated fluid as unusable.

With specific reference to FIGS. 6, 7, 10, and 1, a first embodiment of a heater 500 according to the present invention is illustrated. The heater 500 includes a resistance heating element 400 comprising a resistance heating material encapsulated within a thin electrically insulating polymeric layer 402. The thickness of the polymeric layer preferably ranges from 0.009–0.015 inch around the resistance heating material. The resistance heating material is preferably a resistance heating wire 404 having a pair of terminal ends 406 and comprising a resistance metal of round or flat stock. A popular resistance wire is the Nichrome (Ni—Cr) wire. The wire's cross-section and length are generally related to the total wattage it generates after it is energized with electricity. In some instances, it may be possible to utilize a positive temperature coefficient ("PTC") material for the resistance heating material, such as a PTC wire or sheet, in order to control or sense temperature.

When the heater 500 is used in connection with a food, medical or hygienic application, preferred materials for the polymeric layer 402 include those that are approved by the Food and Drug Administration (FDA) and are extrudable. Examples include polytetrafluroethylene, polysulfone, polycarbonate, polyetherimide, polyether sulfone, and polypropylene. Other examples of acceptable materials for the polymeric layer 402 may include other flurocarbons, epoxies, silicones, phenolics, polyetheretherkeytone, polyphenylene sulfide, or a combination thereof The terminal ends 406 of the resistance heating wire 404 are preferably affixed to a pair of electrical connectors respectively, such as cold pins 408*a*, 408*b*. The cold pins 408*a*, 408*b* are preferably made of a conductive metal, such as copper or steel, and are approximately 1–2 inches in length. The cold pins 408*a*, 408*b* preferably generate little or no resistance heating.

Figure 6:
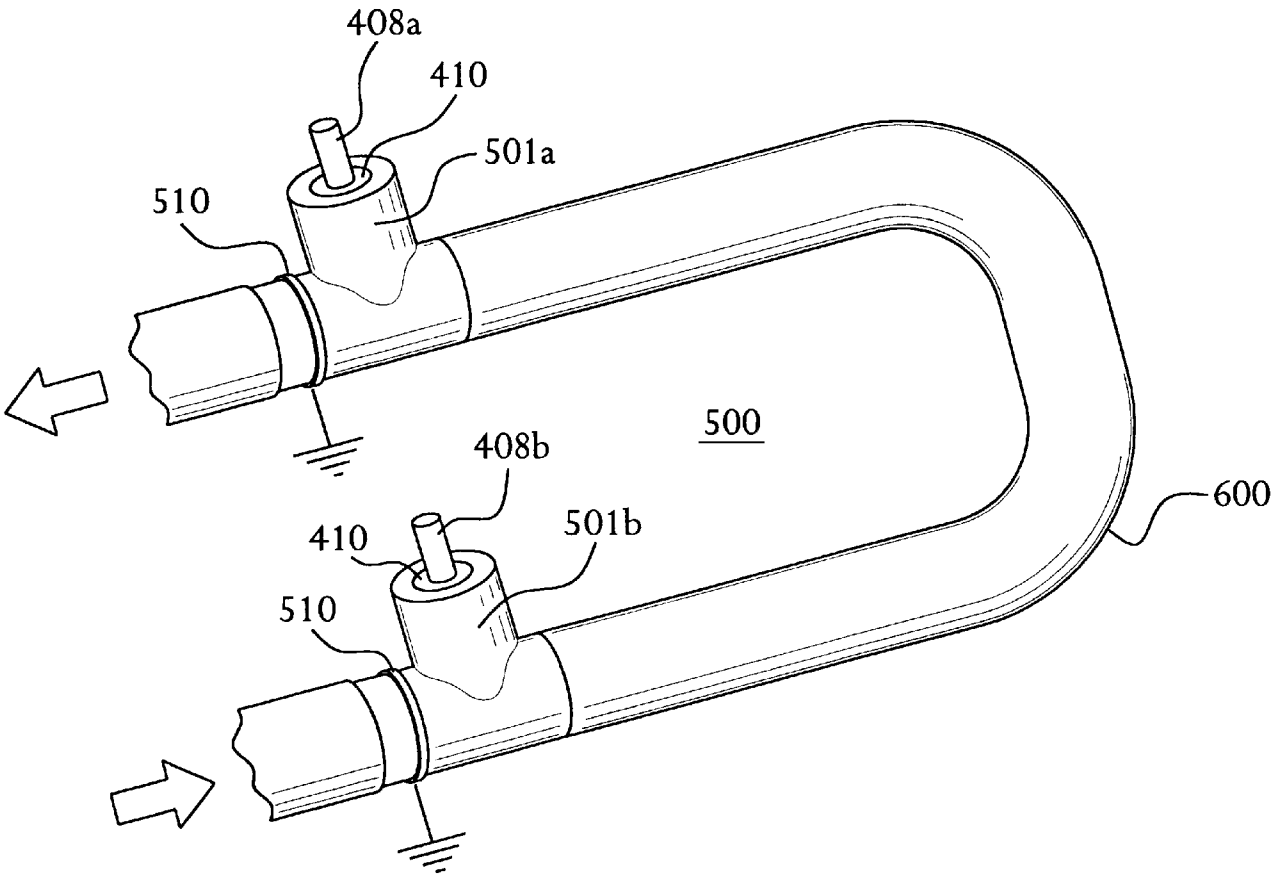
FIG. 6 is a partial, perspective view of a section of pipe including an exemplary embodiment of a heater according to the present invention.
Figure 7:
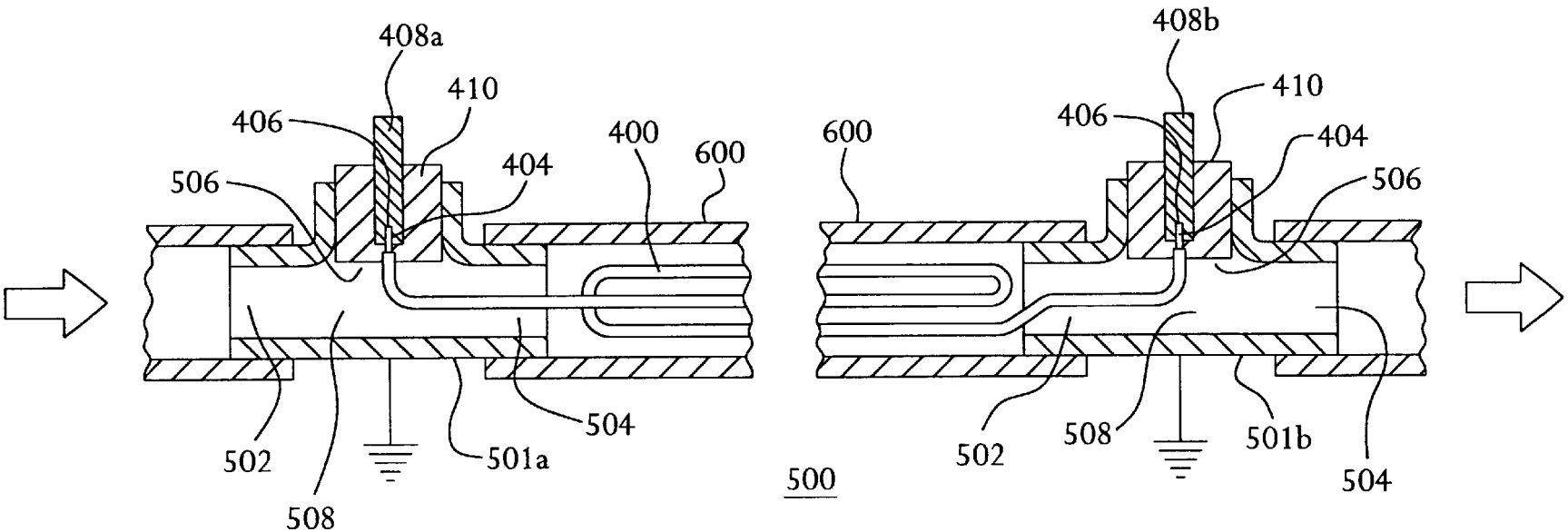
FIG. 7 is a partial, cross-sectional view of a heated section of pipe including an exemplary embodiment of a heater according to the present invention.

With specific reference to FIG. 6 and FIG. 7, a fluid flow is illustrated by directional arrows. The heater 500 includes a first and second connecting bodies 501*a*, 501*b* are shown. The connecting bodies 501*a*, 501*b* may be made of a polymeric or metallic material. The connecting bodies 501*a*, 501*b* of FIG. 6 are preferably formed from a polymeric material, such as PVC or polypropylene, and, therefore, preferably include a ground electrode to protect against stray current leakage. Similarly, the connecting bodies 501*a*, 501*b* illustrated in FIG. 7 can be made of a metallic material, such as nickel plated brass, and may be directly grounded as shown.

Each connecting body 501*a*, 501*b* includes a fluid inlet port 502, a fluid outlet port 504, an electrical connection port 506 and a fluid passageway 508 defined between the fluid inlet port 502 and the fluid outlet port 504. The resistance heating element 400 extends between the connecting bodies 501*a*, 501*b* axially through a section of piping 600 and between the connecting body 501*a* and connecting body 501*b*. The resistance heating element 400 is preferably spirally shaped, such as a coil, or may take on a more random "zig-zag" pattern within the section of piping 600. Regardless of the shape, the resistance heating element 400 is selected to provide sufficient wattage to maintain a fluid in the section of the piping 600 above or at least at its desired use (i.e., output) temperature, e.g., above about 150–190° F., after the fluid is initially heated by a primary fluid heat source. The selection of the resistance heating element 400 may be made by using conventional resistance heating design techniques. Some consideration for construction of the heating element include material selection (both polymer layer 402 and resistance heating wire 404), length of the resistance heating wire, and power supply.

Figure 10:
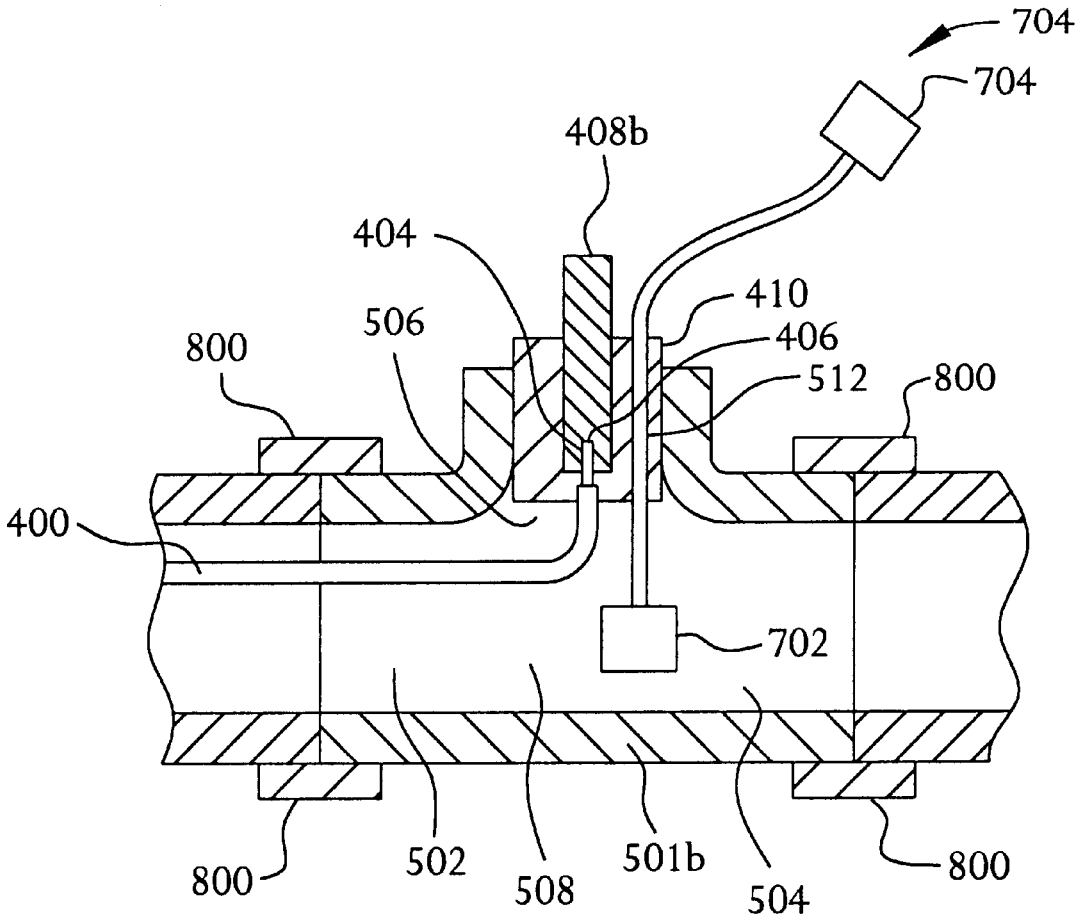
FIG. 10 is a partial, cross-sectional view of another exemplary embodiment of a heater according to the present invention.
Figure 11:
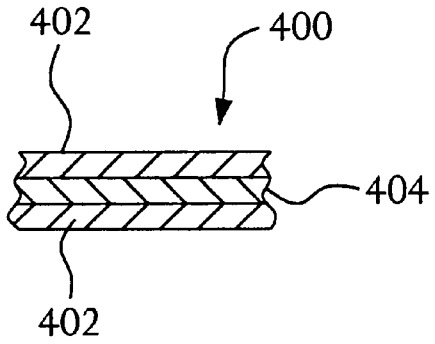
FIG. 11 is a cross-sectional view of an exemplary resistance heating element.

The cold pins 408*a*, 408*b* preferably occupy the majority of the length L (shown in FIG. 8) of the electrical connection ports 506. It is preferred that only a small portion of the resistance heating element 400 occupy this area in order to minimize the portion of the resistance heating element 400 that does not actively heat the fluid. A fluid tight, and preferably electrically insulative, seal 410 is also disposed within the electrical connection port 506. This seal prevents leakage of the fluid outside of the connecting bodies 501*a*,

501*b* and electrically insulates the connection between the terminal ends 406 of the resistance heating wire 404 and the cold pins 408*a*, 408*b*. The seal 410 may include a rubber plug, such as synthetic rubber or silicone, inserted into the electrical connection port 506 and around the connection between the terminal ends 406 and cold pins 408*a*, 408*b* or an clear epoxy filler, such as those sold under the DEVCON trademark and available from the ITW Co. of Danvers, Mass., injected into the electrical connection port 506. Additional dielectric support may be provided to the connection between the cold pins 408*a*, 408*b* and terminal ends 406 if an insulation material 512, such as Teflon (polytetrafluoroethylene) tubing, is heat shrunk around each connection, such as is shown in FIG. 10.

Figure 8:
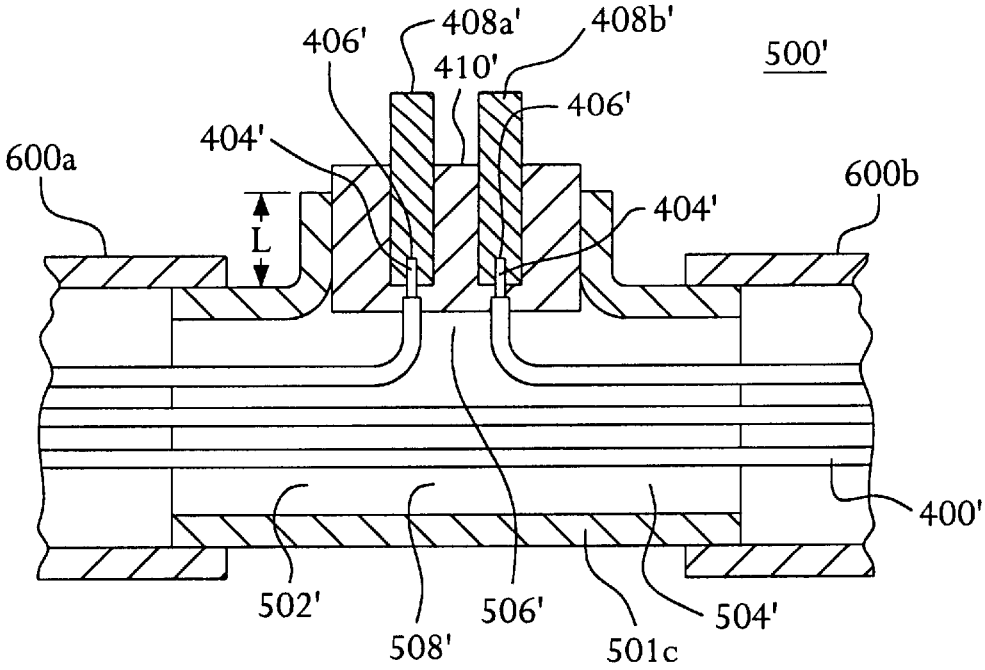
FIG. 8 is a partial, cross-sectional view of another exemplary embodiment of a heater according to the present invention.

A second embodiment of a heater 500' is shown in FIG. 8 where a single connecting body 501*c* is provided. Features similar to those described in connection with FIGS. 6, 7, 10 and 11 are illustrated with a prime (') designation. The embodiment of FIG. 8 illustrates that both cold pins 408*a*' and 408*b*' may occupy the electrical connection port 506' of a connecting body 501*c*. The heating element 400' is preferably configured to extend into piping sections 600*a*, 600*b* to provide resistance heat when the connecting body 501*c* is connected to the piping sections 600*a*, 600*b*.

The resistance heating element 400 is preferably designed to provide enough power to compensate for expected heat losses from the heated fluid to the environment through the pipe section in which the fluid is disposed. A steady-state temperature is preferably achieved where the resistance heating element continuously operates to simply compensate for this heat losses. The heat losses, however, may not remain consistent under all situations, and there may not be a need for the heating element to remain on during times when the fluid is dispensed from the piping system fairly regularly. Therefore, an exemplary heater also preferably includes a temperature control means 700 (as shown in FIG. 10) for selectively activating and deactivating the resistance heating element 400 so that the resistance heating element 400 can operate to maintain the fluid substantially at or above the desired use temperature for the fluid. The temperature control means 700 may include a thermostat or thermocouple 702 preferably disposed within the fluid passageway 508 of a connecting body 501*a*, 501*b*, 501*c* in order to monitor the temperature of the fluid in the passageway 508. External controls 704 may be coupled to both the thermostat 702 and the power source or leads from the power source to cold pins 408*a*, 408*b* in order to activate and deactivate resistance heating element 400 so that the element operates to maintain the temperature of the fluid substantially at a steady state temperature within an acceptable temperature range around the desired use temperature. External controls 704 may include a loop control system including a switch responsive to the sensed temperature, specific variations for which are known to those familiar with designing heating element systems. The desired use temperature or serving temperature, for example, for a hot cup of coffee is approximately 120–160° F. The control means may activate and deactivate the element 400 to insure that the fluid remains within this range. More preferably, the control means may be configured to maintain the temperature at 130°±5° F.

It should be apparent that the appropriate temperature ranges are application and preference specific and the heater 500, 500' of the present invention may be designed accordingly. The appropriate temperature range depends upon the desired use temperature and the location of the heated section of piping. If the heated section of piping, i.e., a section of piping including an embodiment of a heater of the present invention, is disposed an extended distance from the dispensing point for the liquid, a designer may need to account for any heat losses that occur between the heated section of piping and the dispensing outlet. Of course, the entire length of the piping may be heated by one or more heaters functioning independently.

An alternatively to a temperature control means 700 including external controls 704 and thermostat or thermocouple 702 is to select the resistance heating wire of the resistance heating element and voltage source to supply only enough heat to offset thermal losses in the fluid in the piping system and that does not overheat the fluid in the worst case scenario, i.e., when the fluid is stagnant in a given heated section of piping. The heating wire may remain energized even when the fluid continuously flows through the piping section without adversely heating the flowing fluid because much more wattage is required to heat a flowing fluid when compared with a stagnant fluid. A design consideration includes weighing the cost of a temperature control means 700 that includes external controls 704, offset by any energy savings resulting from the use of the temperature control means, against the costs of continuously energizing the resistance heating wire. Of course, this consideration is heating application specific. A second alternative may be to utilize a resistance heating wire that is a PTC wire to control the wattage output of the resistance heating element and to provide an inherent safe mode against overheating if the PTC characteristics of the wire overlap with the desired use temperature and use temperature range of the selected heating application.

Figure 9:
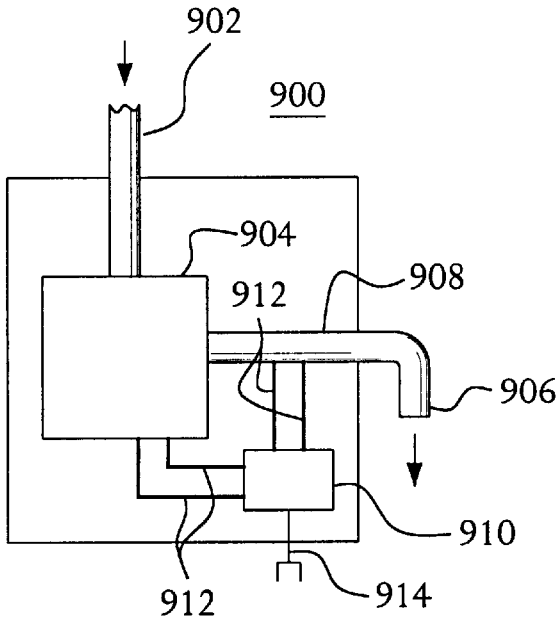
FIG. 9 is a block diagram illustration of an exemplary hot beverage dispensing apparatus.

FIG. 9 is block diagram illustration of an exemplary hot beverage dispensing apparatus 900 which may include a heater of the present invention. The dispensing apparatus 900 includes a fluid intake 902 where water flows into a primary fluid heat source 904. The primary fluid heat source 904 is a high wattage heat source as described in the "Background of the Invention" section above. A section(s) of pipe 908 leads from an output of the primary heat source 904 to a dispensing output 906. The section of pipe 908 may include a heater 500, 500' described above with a resistance heating element 400, 400' disposed axially therethrough along some or all of its length. A power supply 910 connected to an external power source through power lead 914 supplies power through leads 912 to the primary heat source 904 and the heater (not shown) connected to and contained within the section of piping 908.

It should be apparent that the heater of the present invention may be provided as an original component of a fluid heating apparatus or as a retrofitable component. The heater may be formed integral with a section of piping, fitted into an existing section of piping, or be installed as an added length of piping. If a single connecting body 501*c* embodiment is utilized, the connecting body 501*c* may simply be fitted into the pipe section 600*a* and 600*b*, with the resistance heating element 400' extending into the sections 600*a*, 600*b*. If a double connecting body 501*a*, 501*b* embodiment is utilized, the resistance heating element 400 may be fed through a section of piping 600 and then be secured to a pair of electrical connector in the electrical connecting ports 506 of the connecting bodies 501*a*, 501*b*.

The section of piping 600 may be an existing section of piping in a fluid heating system connected to a heater 500. Conversely, a heater 500, 500' may be pre-attached to a section of piping and added to the piping system of the fluid heating system as an added length of piping. Still further, a section of piping may be removed or spliced from the fluid heating system. The removed section of piping (or a new section of piping having equivalent length) may be connected to a heater 500 with a resistance heating element 400 disposed axially therethrough and be reattached to the piping system through connecting bodies 501*a*, 501*b*.

The connecting bodies 501 may be configured to connect to a piping section in several ways. The connecting bodies may be sized to fit within the inside diameter of the piping sections. This may be particularly effective when the piping sections are rubber hoses which tend to form excellent interference fits when fitted together. This interference fit may also be improved if a tie rap or clamp is also employed. Threaded fittings 800 may also be utilized as shown in FIG. 10. These fittings 800 are common in the plumbing industry. An example includes the fitting that is used to attach a conventional garden hose to an outside water spigot.

The heater 500, 500' of the present invention provides several benefits. The resistance heating element 400 need only be capable of low wattages sufficient to compensate for heat losses to the environment surrounding a section of pipe in order to maintain a fluid in a steady-state substantially at or above a desired use temperature. Low watt densities for the encapsulated resistance heating element may be achieved, while placing maximum surface area of the heating element in contact with the fluid. High surface temperatures for the heating element are not generated, thereby reducing scale formation. The life of the resistance heating element is increased, and the heater may utilize existing and standard plumbing fittings.

The heater may be retrofitted into an existing system in very cost effective manner and may be operated at a very cost effective fashion to reduce waste inherent in the operation of those systems, such as coffee, tea, and hot chocolate vending machines. This provides the ability to provide heat in discrete piping section of a system where desired, but previously not considered possible. All of these feature provide a labor and cost efficient manner of providing heating downstream from a primary heat source.

Further, the heater of the present invention, while particularly useful in hot beverage applications, is not limited to use in connection with those applications. The heater may be utilized in the medical, waste processing, and chemical industries, to name a few. One potential application includes maintaining the temperature of water contained in the pipes leading from a hot water heater in a home shower. The heater eliminates the need to run the shower until all of the cooled water contained in the pipes is eliminated.

Although various embodiments have been illustrated, this was for the purpose of describing, but not limiting the invention. Various modifications which will become apparent to one skilled in the art, are within the scope of this invention described in the attached claims.

What is claimed:

1. A hot beverage dispensing apparatus, comprising:

a primary fluid heat source, said primary fluid heat source configured to initially heat a fluid to at least a hot beverage temperature;

a section of piping coupled between an output of said primary fluid heat source and an output of said hot beverage dispensing apparatus;

a low wattage heater disposed in said section of piping to compensate for heat loss to said fluid, said low wattage heater including a resistance heating element including a resistance heating material encapsulated within a thin electrically insulating polymeric layer; and temperature control means for selectively energizing said resistance heating element to maintain said fluid substantially at at least said hot beverage temperature when said fluid is resident within said section of piping.

2. The apparatus of claim 1, wherein said polymeric layer comprises polysulfone, polycarbonate, polyetherimide, polyether sulfone, polypropylene, a fluorocarbon, epoxy, silicone, phenolic, polyetheretherkeytone, polyphenylene sulfide, or a combination thereof.

3. The apparatus of claim 1, wherein said resistance heating element is spirally shaped.

4. The apparatus of claim 3, wherein said resistance heating element forms a plurality of flexible, spiral forms wound along a common axis, said heating element having a Flux or Watt Density which is lower than that for a Tubular Heating Element of substantially similar Active Element Volume ($in^3$), said spirally shaped heating element having the same or greater overall wattage rating (total watts) than said Tubular Heating Element.

5. The apparatus of claim 4, wherein said plurality of spiral forms comprise a circular, square, oval or rectangular shape.

6. The apparatus of claim 3, wherein said resistance heating material comprises a metal ribbon or wire.

7. The apparatus of claim 1, wherein said low wattage heater includes a connecting body connected to said section of piping, said connecting body including a fluid inlet port, a fluid outlet port, an electrical connection port and a fluid passageway defined between said fluid inlet port and said fluid outlet port, said resistance heating element disposed at least partially within said fluid passageway and said section of piping.

8. The apparatus of claim 1, wherein said low wattage heater includes a first and second connecting bodies disposed at a first and second ends of said section of piping, respectively, each of said connecting bodies including a fluid inlet port, a fluid outlet port, an electrical connection port, and a fluid outlet port, at least a portion of said resistance heating element disposed axially through said section of piping.

9. The apparatus of claim 1, wherein said polymeric layer has a thickness of about 0.001–0.020 inches.

10. A hot beverage dispensing apparatus, comprising:

a primary fluid heat source, said primary fluid heat source configured to initially heat a fluid to at least a hot beverage temperature;

a section of piping coupled between an output of said primary fluid heat source and an output of said hot beverage dispensing apparatus;

a low wattage heater disposed in said section of piping to compensate for heat loss to said fluid, said low wattage heater including a flexible, spirally shaped resistance heating element including a resistance heating material encapsulated within a thin electrically insulating polymeric layer; and temperature control means for selectively energizing said resistance heating element to maintain said fluid substantially at at least said hot beverage temperature when said fluid is resident within said section of piping.

11. The apparatus of claim 10, wherein said polymeric layer comprises polysulfone, polycarbonate, polyetherimide, polyether sulfone, polypropylene, a fluorocarbon, epoxy, silicone, phenolic, polyetheretherkeytone, polyphenylene sulfide, or a combination thereof.

12. The apparatus of claim 10, wherein said resistance heating element forms a plurality of flexible, spiral forms wound along a common axis, said heating element having a Flux or Watt Density which is lower than that for a Tubular Heating Element of substantially similar Active Element Volume ($in^3$), said spirally shaped heating element having the same or greater overall wattage rating (total watts) than said Tubular Heating Element.

13. The apparatus of claim 12, wherein said plurality of spiral forms comprise a circular, square, oval or rectangular shape.

14. The apparatus of claim 10, wherein said resistance heating material comprises a metal ribbon or wire.

15. The apparatus of claim 10, wherein said low wattage heater includes a connecting body connected to said section of piping, said connecting body including a fluid inlet port, a fluid outlet port, an electrical connection port and a fluid passageway defined between said fluid inlet port and said fluid outlet port, said resistance heating element disposed at least partially within said fluid passageway and said section of piping.

16. The apparatus of claim 10, wherein said low wattage heater includes a first and second connecting bodies disposed at a first and second ends of said section of piping, respectively, each of said connecting bodies including a fluid inlet port, a fluid outlet port, an electrical connection port, and a fluid outlet port, at least a portion of said resistance heating element disposed axially through said section of piping.

17. The apparatus of claim 10, wherein said polymeric layer has a thickness of about 0.001–0.020 inches.

* * * * *